US007093689B2

(12) United States Patent
Poldmaa

(10) Patent No.: US 7,093,689 B2
(45) Date of Patent: Aug. 22, 2006

(54) LADDER SUPPORT BRACKET

(76) Inventor: Arvo Poldmaa, 16 Moola Street, Hawks Nest NSW 2324 (AU)

( * ) Notice: Subject to any disclaimer, the term of this patent is extended or adjusted under 35 U.S.C. 154(b) by 0 days.

(21) Appl. No.: 10/692,869

(22) Filed: Oct. 24, 2003

(65) Prior Publication Data

US 2004/0135037 A1 Jul. 15, 2004

Related U.S. Application Data

(63) Continuation of application No. PCT/AU02/00515, filed on Apr. 24, 2002.

(30) Foreign Application Priority Data

Apr. 24, 2001 (AU) ..... PR4544

(51) Int. Cl.
*E04G 5/02* (2006.01)
*E04D 13/072* (2006.01)

(52) U.S. Cl. ..... 182/107; 248/48.2; 52/11

(58) Field of Classification Search ..... 182/107, 182/214, 229, 210, 230, 129, 45, 108, 111; 248/238, 48.1, 210, 48.2; 52/11–16; D25/62–69
See application file for complete search history.

(56) References Cited

U.S. PATENT DOCUMENTS 2,407,541 A * 9/1946 Ehnborn ..... 182/214
2,423,189 A * 7/1947 Honhart ..... 7/145
2,815,160 A * 12/1957 Gilmour et al. ..... 182/107
2,856,112 A * 10/1958 Broderick ..... 182/117
3,007,662 A * 11/1961 Featheringham ..... 248/48.2
3,053,491 A * 9/1962 Ramser ..... 248/48.2
3,318,416 A 5/1967 Robinson
3,603,431 A 9/1971 Nameche
3,737,127 A * 6/1973 Maloney et al. ..... 248/48.2
4,369,860 A * 1/1983 Beane ..... 182/214
4,643,275 A * 2/1987 LeBlanc ..... 182/107
4,823,912 A * 4/1989 Gould et al. ..... 182/214
4,940,198 A * 7/1990 de Wilde ..... 248/48.1
5,358,071 A * 10/1994 Stennett ..... 182/214
5,495,694 A * 3/1996 Kuhns ..... 52/12
5,497,848 A * 3/1996 Travis ..... 182/107
5,529,145 A * 6/1996 Allred ..... 182/107
5,743,356 A * 4/1998 Mitchell ..... 182/214
5,775,465 A * 7/1998 Vossler ..... 182/214

(Continued)

FOREIGN PATENT DOCUMENTS

AU 200047171 A1 1/2001

(Continued)

*Primary Examiner*—Hugh B. Thompson, II
(74) *Attorney, Agent, or Firm*—Akin Gump Strauss Hauer & Feld, LLP

(57) ABSTRACT

A ladder support bracket (11) receives a rung of a ladder intended to be placed against the gutter (19) of a building and thus restraining it, and hence the ladder, from sideways or downwards movement. The bracket includes a first region (12) for affixing to a rigid portion of the building, a second region (13) which spans the gutter, and a third region (14) in the form of a cradle for receiving the rung of the ladder. The ladder support bracket preferably has the first region for fixing the bracket to a rigid portion of the building in the form of a relatively planar sheet like portion which may be attached by suitable fasteners, such as screws (22, 23) or the like, to the rafters (18) or other timber members of the roof support structure of the building, such as battens (21), this portion then being covered by the roofing material, whether tiles or metal roofing.

9 Claims, 2 Drawing Sheets

U.S. PATENT DOCUMENTS

| | | | | | |
|---|---|---|---|---|---|
| 5,896,706 | A | * | 4/1999 | Pike | 52/11 |
| 5,971,100 | A | * | 10/1999 | DeLeon et al. | 182/107 |
| 6,009,974 | A | * | 1/2000 | Jones | 182/107 |
| 6,019,191 | A | * | 2/2000 | Flores | 182/107 |
| 6,029,774 | A | * | 2/2000 | Cothern | 182/107 |
| 6,460,811 | B1 | * | 10/2002 | Miller | 248/48.2 |
| 6,691,829 | B1 | * | 2/2004 | Stelmach | 182/214 |
| 6,722,469 | B1 | * | 4/2004 | Weger, Jr. | 182/107 |
| 2004/0040220 | A1 | * | 3/2004 | Baker | 52/12 |
| 2004/0055820 | A1 | * | 3/2004 | Charlton | 182/107 |
| 2004/0089501 | A1 | * | 5/2004 | Hockensmith | 182/107 |
| 2004/0250478 | A1 | * | 12/2004 | McDonald et al. | 52/11 |
| 2005/0115158 | A1 | * | 6/2005 | Brown | 52/11 |

FOREIGN PATENT DOCUMENTS

| | | | | |
|---|---|---|---|---|
| GB | 2118236 | * | 3/1983 | 182/107 |
| JP | 13233 | * | 1/1999 | 182/107 |
| JP | 11-247571 A | | 9/1999 | |

* cited by examiner

LADDER SUPPORT BRACKET

CROSS-REFERENCE TO RELATED APPLICATIONS

This application is a continuation of International Application No. PCT/AU02/00515, filed Apr. 24, 2002, which was published in the English language on Oct. 31, 2002, under International Publication No. WO 02/086275 A1 and the disclosure of which is incorporated herein by reference.

BACKGROUND OF THE INVENTION

This invention relates to a support bracket for a ladder and in particular a support bracket to be affixed in the region of a house gutter to prevent a ladder from being dislodged when the ladder is being thus used against the gutter.

Although the following description refers to ladders generally, no limitation is intended thereby. Any related device including, but not necessarily limited to, step ladders, fixed length ladders, extension ladders, trestles, work platforms or scaffolding, requiring a ladder like element to be placed against a building, is also contemplated. Again, although the following description refers primarily to conventional houses or buildings having a gutter mounted on a conventional fascia, no such limitation is intended, and any analogous use of a ladder whether against a gutter or otherwise is meant to be included, where by suitable adaptation the invention may be so employed.

Of necessity, ladders are used on a variety of surfaces and in many instances the ground or surface on which they are used is uneven, sloped or stepped. This in itself makes the ladder prone to movement when a person stands on any of the higher rungs of the ladder, especially if the ground is soft or otherwise less stable than expected. Although some surfaces against which a ladder can be placed or leant do provide a degree of frictional contact to prevent sideways slippage, eg rough brick work or render, contact of a ladder against a gutter is especially problematic, as the ladder to gutter contact is often a relatively slippery one, being inherently metal to metal (or metal to plastics in some cases).

It should be noted that whilst it might be preferable to avoid leaning the ladder against a gutter at all, this is usually the only suitable way of gaining access to the roof above, if the person using the ladder requires to have such access. In other words using a ladder against a gutter in many instances simply cannot be avoided. However, it would also be useful if the ladder did not in fact contact the gutter at all, especially if the gutter is made of plastics or formed from aluminium, as the gutter may be damaged.

In any event, even when used on stable level ground there is still an inherent risk of the ladder, especially when used over longer reaches, sliding sideways when it is leant against a gutter, especially in situations where there might be sudden weight transference or over-reaching by the person concerned. Even the very mode of gaining access to the roof area means the ladder may be moved sideways as the user takes his weight off the ladder and steps onto the roof, or much more dangerously steps from the roof onto the ladder, which might unexpectedly move away.

It would therefore be extremely advantageous to provide a simple means of providing a safe way to prevent the ladder from moving sideways along the gutter in such situations, which is itself relatively easy to use and economical. It would also be advantageous if such means also meant that the ladder itself was not actually resting on the gutter.

BRIEF SUMMARY OF THE INVENTION

The present invention has therefore been conceived out of the need to provide a relatively inexpensive but safe bracket arrangement for use in the vicinity of a gutter, whereby an upper rung of a ladder or similar device can be restrained from sideways movement, preferably whilst keeping the ladder from actually contacting the gutter. In other words, a support bracket designed to allow a ladder to be safely leant against a gutter of a building or the like (or otherwise supported as if it were leant against the gutter), preventing it from moving either sideways and/or downwardly, is thus contemplated. At the very least, the invention provides an alternative to presently known methods of restraining the movement of ladders when used against buildings and/or reducing damage caused from ladders placed against gutters.

According to the present invention there is provided a bracket arrangement for receiving a rung of a ladder intended to be placed against the gutter of a building and thus restraining it, and hence the ladder, from sideways or downwards movement, the bracket comprising a first region for affixing to a rigid portion of the building, a second region which spans the gutter, and a third region in the form of a cradle for receiving the rung of the ladder.

Preferably, the first region for fixing to a rigid portion of the building is in the form of a relatively planar sheet like portion which may be attached by suitable means such as screws or the like to the rafters or other timber members of the roof support structure such as battens, this portion then being covered by the roofing material whether tiles or metal roofing. It will be appreciated that this method of attachment is particularly discrete, as the only exposed part of the bracket is that portion extending in from of the gutter into which the rung of the ladder is fitted, there being no untidy external fitting. In this way too, any combination of gutter and/or fascia, or indeed roof edge without either a gutter or fascia, will allow for fitting of the ladder support bracket.

Preferably, the second region spans the gutter so that in use the ladder does not actually make contact with the gutter.

The bracket is preferably made from suitable sheet metal such as aluminium, or from plastics or a composite material. Preferably the bracket is moulded to shape, by any suitable process for forming the shape according to known means, depending on the material chosen may be utilised. As the bracket will be preferably left in place, it should have not only sufficient strength and rigidity to support the ladder and prevent it from slipping sideways or downwards, but also it should be able to withstand the elements. It has been found that so-called "marine-grade" aluminium is particularly suitable having excellent durability when exposed to the elements and having a greater degree of strength than conventional grades of aluminium.

The unique moulded design of a preferred embodiment of the invention is simply placed under the roof sheeting or tiles of a convention roof and is secured to the top of a rafter and/or roof batten(s) and sits in or across the gutter with a section protruding over the gutter visible from the ground making the bracket easily accessible to the worker below who simply places a rung of the ladder in the bracket and hence effectively and safely places the ladder against the building. This prevents the ladder from moving either sideways or downwardly, thus providing a safe access point to the roof area.

It will be understood that the ladder support brackets in accordance with the invention may be fitted to a roof having any pitch as described, the only change being the angle between the respective regions to accommodate such changes in pitch. It has been found that a single profile as far as the manufactured bracket is concerned, will generally suffice, the bracket then being bent or angled further as required at the time of installation to suit the particular pitch. Here again, the use of the aforementioned marine grade aluminium provides a particularly suitable material having the necessary degree of flexibility coupled with its strength and rigidity to conveniently allow such on-site manipulation during the installation process.

Preferably the bracket is also provided with securing points, eg hooks or holes or other suitable sites, for tying off or additionally securing the ladder by such means as ropes, ties, rubber straps etc in otherwise known fashion.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
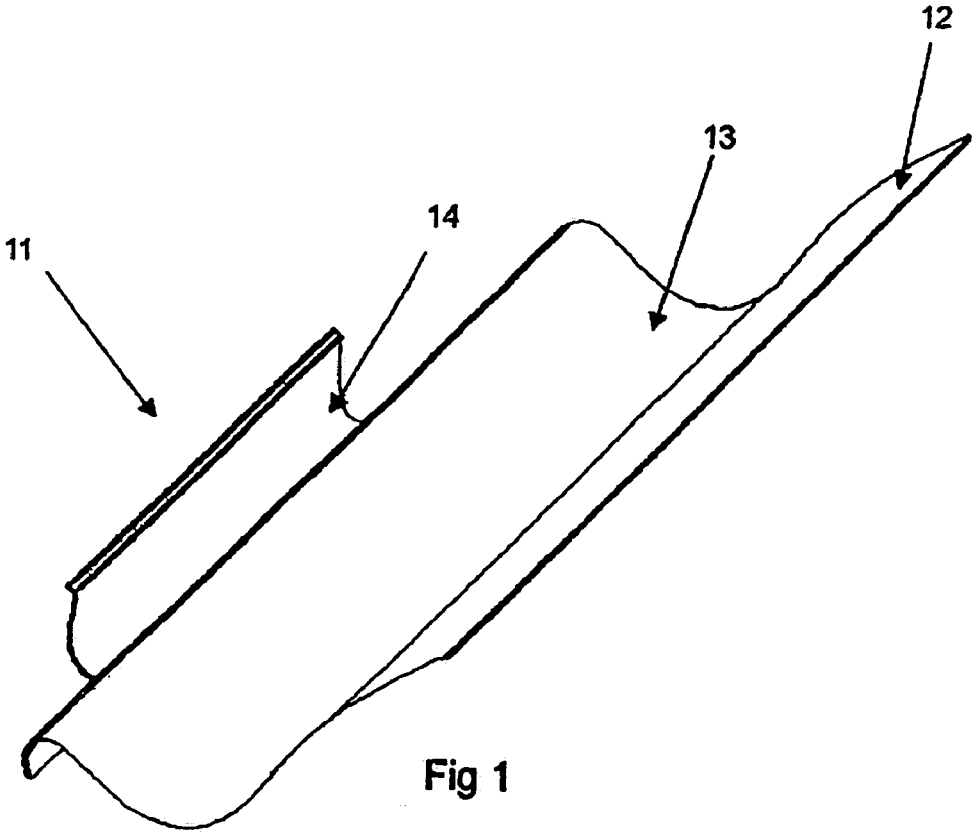
FIG. 1 is a perspective view of a ladder support bracket according to one aspect of the invention.
Figure 2:
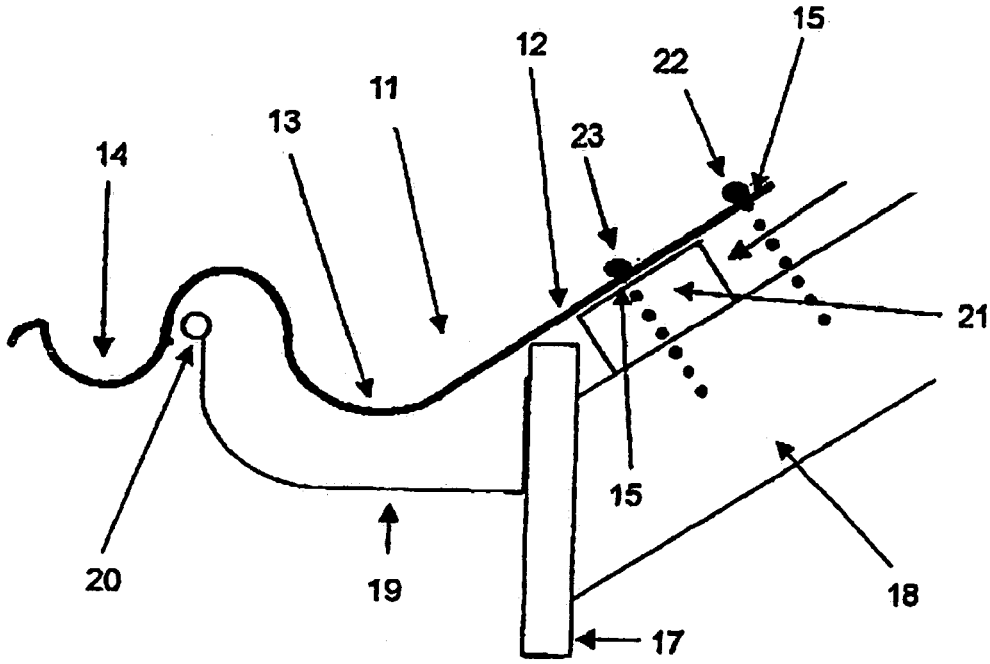
FIG. 2 is a cross-sectional side view of the bracket of FIG. 1, showing the bracket affixed to the roof/gutter area of a typical house ready for use.
Figure 3:
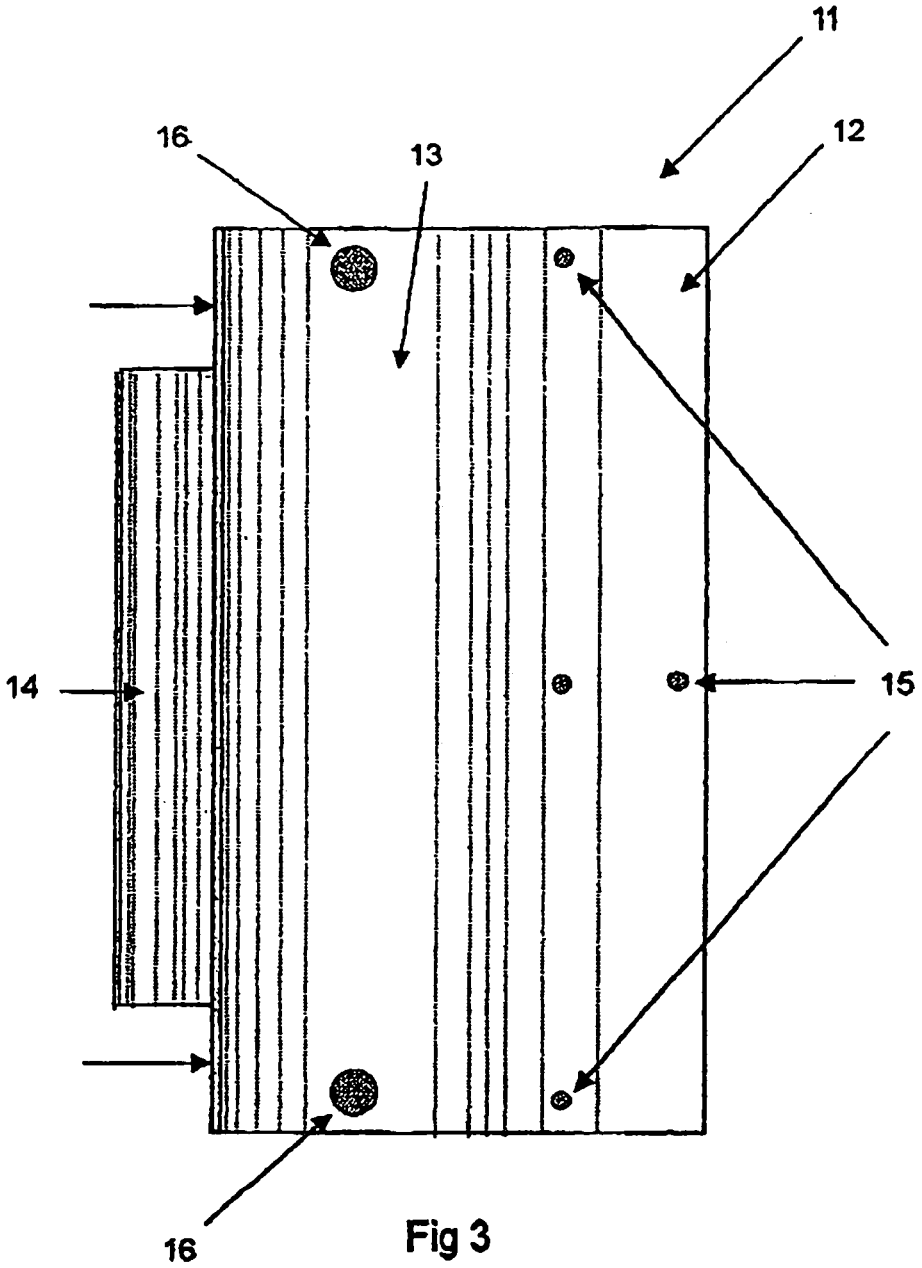
FIG. 3 is a plan view of the bracket of FIG. 1.
Figure 4:
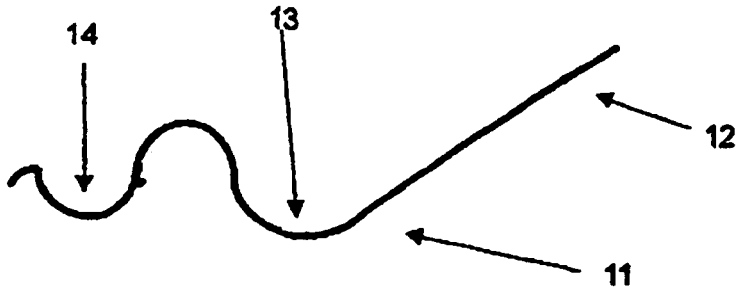
FIG. 4 is an end view of the bracket of FIG. 1.

Referring generally to FIG. 1 and FIGS. 3 and 4, there is illustrated a ladder support bracket generally referenced 11, comprising three regions, 12, 13 and 14. These are firstly a relatively planar region 12 for fitting to the timber structure under a conventional tile or metal roof (as shown in FIG. 2 and discussed below), a second gutter spanning region 13, in this case able to extend downwardly into the gutter and able to rise above the lip of a gutter (again as shown in FIG. 2), and a third region 14 being a cradle like member for supporting a rung of a ladder (not shown).

Fixing region 12 is provided with a first series of holes 15 through which suitable screws or other fixing means may be utilised to attach the ladder bracket 11 to the roof timbers (as shown in FIG. 2). It will also be understood that these holes may in fact be formed in situ by the very penetration of screws or other fixing means therethrough.

The gutter spanning region 13 however is preferably provided with larger diameter holes 16 so that suitable ties (not shown) may be utilised to provide additional restraint against unwanted lateral or downwards movement of the ladder.

It will be appreciated that the cradle 14 will only need to be sufficiently deep to prevent the sideways movement of the ladder in what would be considered normal use, as any excessive depth will only make it that much difficult to place the rung of the ladder therein in the first place. A similar consideration will apply to the length of the cradle 14, which should be sufficiently wide as to not allow too great a lateral movement when undue sideways forces are exerted on the ladder, but not so wide that a conventional ladder will not fit therein or only so snugly that it becomes inconvenient to fit the rung or indeed remove it when finished.

On the other hand it will be appreciated that the overall width of at least the fixing region 12 should be sufficient to comfortably span the expected roof timbers, the rafters of which are often based on 450 mm or 600 mm centre to centre spans. Thus it is recommended that the width of the bracket in region 12 should at least allow for this, although fixing may be to cross battens etc and hence even these dimensions should not be seen as critical. Indeed, considering the very geometry, it will be appreciated that the leading edge of the gutter spanning region 12 will itself provide additional support for the side members of the ladder in additional to that provided by the cradle 14 for the rung, thereby further reducing the likelihood of damage to the gutter itself, compared to the situation if the bracket 11 were not used.

Thus referring specifically to FIG. 2, it will be observed how fixing of the ladder bracket 11 to a conventional house structure may be accomplished. The house will generally have a fascia 17 affixed to a rafter 18 by known means. Attached to the front of the fascia 17, is a gutter 19 having an outwardly extending lip 20. Along the upper surfaces of the rafters 18 cross members generally known as battens 21 are affixed. In the case of a tile roof, the bracket 11 is conveniently affixed to the battens 21 and/or rafters 18 by suitable length screws 22 and 23 respectively. Tiles (not shown) may then be laid over the upper fixing region 12 of the bracket 11, to finish the roof.

In the case of a metal roof, the same sort of fixing may be accomplished, the roof being laid over the already affixed ladder bracket 11, or where the roof is already laid, it may be preferred to simply remove some fixing screws, slide the fixing region 12 of the bracket 11 up under the metal sheeting and then screw down again through both the metal sheeting and that portion 12 of the ladder bracket 11.

It will be clear from FIG. 2, that in use, when the rung of a ladder is inserted into the cradle 14, that the ladder will be prevented from coming into contact with the lip 20 of gutter 19, and by virtue of the side arms of the ladder, the rung and hence the ladder will be prevented from moving sideways or downwardly, thus providing a much safer environment than if the ladder bracket 11 were not used.

Throughout the specification the word "comprise" and its derivatives are intended to have an inclusive rather than exclusive meaning unless the context requires otherwise.

The invention has industrial applicability at least in relation to the use of ladders when used against buildings, especially those having gutters about the periphery of their roof area.

The foregoing describes only one embodiment of the present invention, and modifications obvious to those skilled in the art can be made thereto without departing from the scope of the present invention.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A ladder support bracket for receiving a rung of a ladder intended to be placed against a gutter of a building and thus restraining the ladder from sideways or downwards movement, the bracket formed from a unitary rigid sheet material, comprising a first flat region, at least one fastener secured to said first flat region and being adapted to be secured to a rigid portion of the building, a second region integrally formed with the first region and adapted to span over the gutter, and a third region integrally formed with the second region and in the form of a cradle of generally concave shape adapted to receive and support the rung of the ladder so that when the ladder is in use and is adjacent the gutter, a rung of the ladder is received in the cradle.

2. A ladder support bracket according to claim 1, wherein the first region which is adapted to be secured to a rigid portion of the building is in the form of a relatively planar sheet like portion which is adapted to be secured to a timber members of a roof support structure of the building by attachment means in the form of screws.

3. A ladder support bracket according to claim 1, wherein the second region spans the gutter so that in use the ladder does not actually make contact with the gutter.

4. A ladder support bracket according to claim 3, wherein side rails of a ladder thus used with the bracket are additionally prevented from contacting the gutter by virtue of their resting against the leading edges of the gutter spanning region, said leading edges formed by virtue of the width of the cradle being less than the width of the gutter spanning region.

5. A ladder support bracket according to claim 1, in which the bracket is made a material selected from the group consisting of sheet metal, aluminum, marine grade aluminum, plastic and a composite material.

6. A ladder support bracket according to claim 1, in which the bracket is molded to shape by a process for forming the shape appropriate to a material chosen.

7. A ladder support bracket according to claim 1, wherein the bracket is permanently fixed to the rigid portion of the building.

8. A ladder support bracket according to claim 1, wherein the bracket is further bendable on site at the time of installation to the building to accommodate a particular pitch of the roof to which it is to be fitted.

9. A ladder support bracket according to claim 1, in which the bracket is also provided with securing points, in the form of hooks or holes, for tying off or additionally securing the ladder thereto by utilizing ropes, ties, or rubber straps in conjunction with the securing points.

* * * * *